US005875791A

United States Patent [19]

Sheffler et al.

[11] Patent Number: 5,875,791

[45] Date of Patent: Mar. 2, 1999

[54] MASCARA CONTAINER AND APPLICATOR

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 70,533

[22] Filed: Apr. 30, 1998

[51] Int. Cl.[6] ..... A45D 40/26

[52] U.S. Cl. ..... 132/218; 132/317; 401/122

[58] Field of Search ..... 132/218, 313, 132/317, 216; 401/122, 129

[56] References Cited

U.S. PATENT DOCUMENTS

| | | | |
|---|---|---|---|
| 3,558,022 | 1/1971 | Zytke | 401/122 |
| 3,921,650 | 11/1975 | Montgomery | 132/218 |
| 4,403,624 | 9/1983 | Montgomery | 132/218 |
| 4,598,723 | 7/1986 | Cole | 132/218 |
| 5,190,389 | 3/1993 | Vasas | 401/122 |
| 5,201,809 | 4/1993 | Miura | 132/218 |
| 5,349,972 | 9/1994 | Dirksing et al. | 132/218 |
| 5,722,436 | 3/1998 | Vandromme et al. | 132/313 |

FOREIGN PATENT DOCUMENTS

| | | | |
|---|---|---|---|
| 3704496 | 10/1967 | Germany | 401/122 |
| 93/01736 | 2/1993 | WIPO | 401/122 |

*Primary Examiner*—Todd E. Manahan

*Attorney, Agent, or Firm*—H. Gibner Lehmann; K. Gibner Lehmann

[57] ABSTRACT

A container and dispenser device for mascara and like products, consists of a shouldered bottle and a screw cap applicator which is screwed onto the bottle. In the bottle neck there is situated a shroud or separator member which has unique doctor means in the form of hinged webs which surround the actuator rod and control the amount of product which adheres to the applicator brush when the latter is withdrawn for use. Cooperable with the hinged webs is a circular bead on the applicator rod, which is engageable with the webs and normally constitutes a seal to prevent product from invading the shroud. Various types and shapes of doctoring webs are used, in various combinations to produce "clean" and also "product carrying" portions on the brush, thereby to enable a combing action to be had by the user, and the applicator rod can extend for an appreciable distance below the shroud and into the product contained in the bottle.

9 Claims, 4 Drawing Sheets

MASCARA CONTAINER AND APPLICATOR

CROSS REFERENCES TO RELATED APPLICATIONS

U.S. application Ser. No. 08/714,200 filed Sep. 16, 1996, entitled SAMPLER DEVICE FOR MASCARA AND OTHER COSMETIC SUBSTANCES, having common ownership with this application.

U.S. application Ser. No. 08/990,977 filed Dec. 15, 1997, entitled MASCARA CONTAINER AND DISPENSER, having common ownership with this application.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to devices for containing and dispensing mascara and like cosmetics.

2. Description of the Related Art Including Information Disclosed Under 37 CFR §§1.97–1.99

U.S. Pat. No. 5,324,128 dated Jun. 28, 1994 shows a spill-preventing cosmetic applicator wherein a small bottle carries mascara or similar cosmetic substance. By a series of seals and small passages it is claimed that leakage and spillage of the bottle contents are prevented. However, multiple components of somewhat complicated shapes are involved, with the result that labor in assemblage becomes significant, as well as component costs, and maximum economy of manufacture is difficult to obtain.

The disclosure of U.S. Pat. No. 4,470,425 involves a mascara container and applicator wherein multiple wiper devices are provided, one for the applicator brush and the other for the brush carrier rod. Both wiper devices are positioned close to each other, and the rod wiper engages and seals against the side wall of the carrier rod, approximately midway between the rod ends. Thus, lower portions of the rod are exposed to the mascara product which is in the container, and the cleanliness of this rod portion depends on the efficacy of the wiper device. If the wiper deteriorates or loses elasticity, the carrier rod can become smudged and cause a messy operation.

In the first-mentioned U.S. Application above identified, a mascara sampler device is disclosed that does not effect a doctoring of the product being removed from the container but does provide a considerable simplification of structure and economy of manufacture while at the same time overcoming other disadvantages of the 1994 patent. It is applicable to small sampling quantities, but its construction does not favor extended use.

Copending U.S. application Ser. No. 08/990,977 identified above discloses a mascara dispenser where a shroud or separator member is provided with fixed interior doctoring edges or masks that have variously-shaped openings for the applicator rod and brush to pass through, for the purpose of controlling the amount of product which is brought out by the brush. This represents one simple method of accomplishing the desired control. Also, dependence on simultaneous seals at different locations but with a single movement could result in manufacturing and assembly problems involving various components. Since the rod portion of the applicator is never in contact with mascara, no wiping of the rod is necessary. However, there is a limited extension of the rod in product below the separator. This may require an unusually long spring wound brush.

Other prior patented devices also suffered from poor sealing, with the result that liquid product could leak from the container and soil surrounding articles. If a user were to be careless in the replacement of the applicator of these prior devices, such leakage would very likely occur.

Additionally, prior devices are unable to conveniently provide, using the same applicator, a combing action after the application of the mascara product. Often it is necessary to "dress down" the applied mascara, and users resort to a separate brush for this purpose, which can be inconvenient.

SUMMARY OF THE INVENTION

The above drawbacks of prior mascara container and dispenser devices are obviated by the present invention, and one object of the invention is to provide an improved mascara container and dispenser which provides a better control and doctoring of the container contents when the brush or applicator is being removed for use.

A further object of the invention is to provide an improved container and dispenser as above characterized, wherein unique means are provided to enable a convenient combing action of the eyelashes to be carried out by the same applicator, after the application of the mascara.

An additional object of the invention is to provide an improved container and applicator wherein one section of the brush is wiped relatively clean and usable as a comb, whereas a sufficient quantity of the product is delivered to another section of the brush, all being accomplished with the single withdrawal movement of the applicator from the bottle.

Another object of the invention is to provide an improved container and applicator device as above set forth, which is especially simple in its structures while at the same time being leakproof and spillproof.

A still further object of the invention is to provide an improved mascara dispenser device in accordance with the foregoing, which is especially economical to produce.

Yet another object of the invention is to provide an improved mascara dispenser as above characterized, which is small and compact as well as being reliable in its operation at all times.

An additional important object of the invention is to provide a container and dispenser as above outlined, wherein improved sealing is had, especially in connection with liquid product, and wherein such sealing does not deteriorate during an extended use of the dispenser.

A feature of the invention is the provision of sealing means which is yieldable to a degree, enabling manufacturing tolerances to be made more liberal without adversely affecting results.

In accomplishing the above objects the invention provides a mascara container and dispenser device comprising a bottle for holding said cosmetic substances, said bottle having an externally threaded neck of reduced diameter, a molded plastic screw cap applicator comprising a body which is screwed on said bottle neck, said screw cap body having a transverse sealing wall disposed intermediate its ends, having an applicator rod extending downward from the transverse sealing wall with the upper half portion of said rod forming an annular cavity in the underside of the screw cap body, which cavity is occupied by the reduced neck of the bottle. The lower half portion of the applicator rod projects from the bottom of the screw cap body and carries at its lower extremity an applicator brush that is connected at a junction to the lower extremity of the rod. A cup-shaped separator member extends through and is carried by the reduced neck portion of the bottle. The separator member encloses an intermediate portion of the applicator rod and has a unique doctoring and sealing means which engages the applicator rod and provides superior control of the amount of cosmetic substance that is to be withdrawn by different portions of the brush so as to enable a combing action to be also carried out thereby, as well as improved sealing of the container. The control or doctoring of the applicator is accomplished by unique webs in the separator member, which are movable between raised doctoring positions and lower, sealing positions. Such webs determine "clean" and "product carrying" portions of the brush and when the webs are in their lowered positions, they can be engaged by a sealing bead on the applicator member. The separator member also has a depending annular skirt that projects downward from the doctor means, in one embodiment of the invention, such skirt carrying horizontally extending wings which are engageable under the bottle internal shoulder to retain the member in an assembly-forced position in the neck. In addition, the separator member has an upper flange portion that is engageable with the bottle lip and also with the transverse sealing wall of the screw cap body at the time that the applicator rod is replaced in the bottle by the user, thereby to enclose and isolate the applicator rod and prevent its contamination.

Other features and advantages will hereinafter appear.

BRIEF DESCRIPTION OF THE DRAWINGS

In the accompanying drawings, illustrating several embodiments of the invention.

DESCRIPTION OF THE PREFERRED EMBODIMENTS

Figure 1:
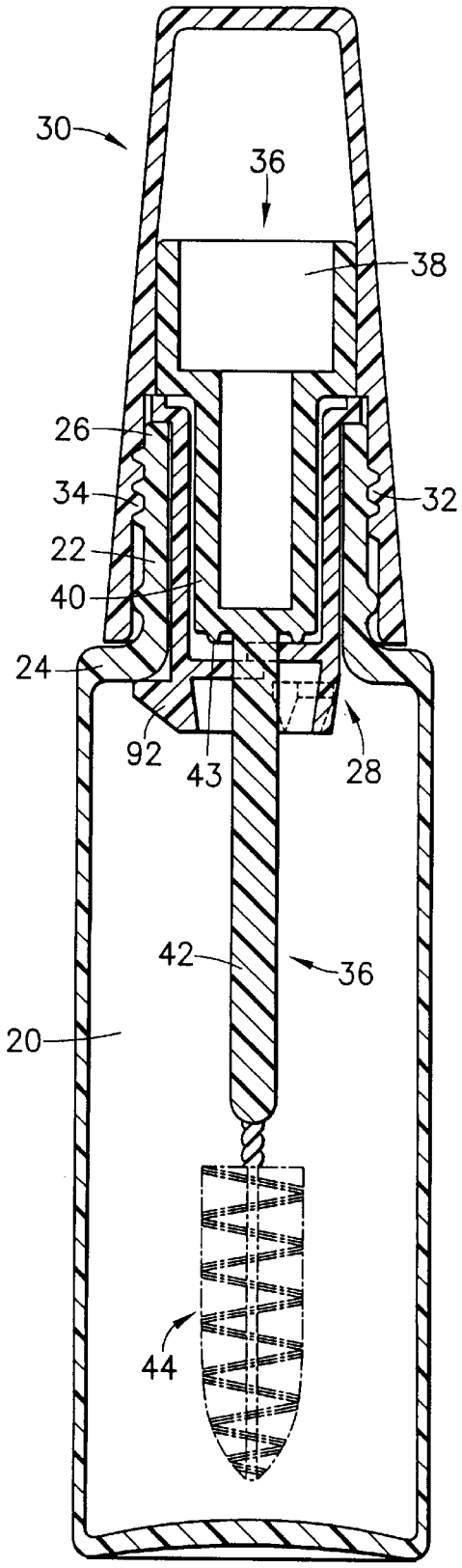
FIG. 1 is an axial sectional view (enlarged) of one preferred embodiment of the improved mascara container and applicator of the invention.

Referring first to FIG. 1, the present improved mascara container and applicator as shown comprises a small bottle or vial 20 which can be of molded plastic construction, having an externally threaded neck 22 of reduced diameter which forms an internal shoulder 24. The bottle 20 has as top sealing land or rim portion 26 which presents a sealing surface for engagement with a cup-shaped shroud 28 shortly to be described.

On the bottle 20 there is a molded plastic screw cap applicator assemblage designated generally by the numeral 30, such assemblage having a body portion 32 provided with internal threads 34 for engagement with the screw threads of the bottle neck 22. The body 32 of the screw cap assemblage 30 has an internal annular sealing surface provided by a molded plastic applicator rod insert designated generally by the numeral 36, which insert is fitted into the cap body 32.

As seen in FIG. 1, the applicator rod insert 36 has three different-diameter sections or portions, a large diameter portion 38 which fits into the body 32 of the assemblage 30, an intermediate-diameter portion 40 and a small diameter portion 42. The large diameter portion 38 makes a shoulder with the intermediate-diameter portion 40, and such shoulder constitutes the above-mentioned internal annular sealing surface of the screw cap assemblage 30. The rod portion 42 is seen to extend downward from the applicator body 32, as shown in FIG. 1.

Also, the intermediate-diameter portion 40 makes a shoulder with the lower, small-diameter portion 42 of the rod assemblage 36, on which shoulder a circular sealing bead 43 is provided to seal with webs 74 and 76 of FIG. 7 described later. It will be understood that the rod assemblage 36 is rigidly affixed in the cap body 32.

The intermediate portion 40 of the applicator rod assemblage 36 forms, with the cap body 32, an annular cavity which is occupied by the reduced neck 22 of the bottle 20.

The lower portion 42 of the applicator rod 36 carries at its lower extremity an applicator brush 44 constituted of a twisted wire and bristle assemblage generally known in the art, which forms a junction at such extremity with the plastic of the rod. However, in accordance with the present invention, the brush bristles can advantageously have a diameter in excess of 0.004" so that it can have the double function of applying the mascara and also combing the user's eyelashes, as will be later brought out.

Figure 2:
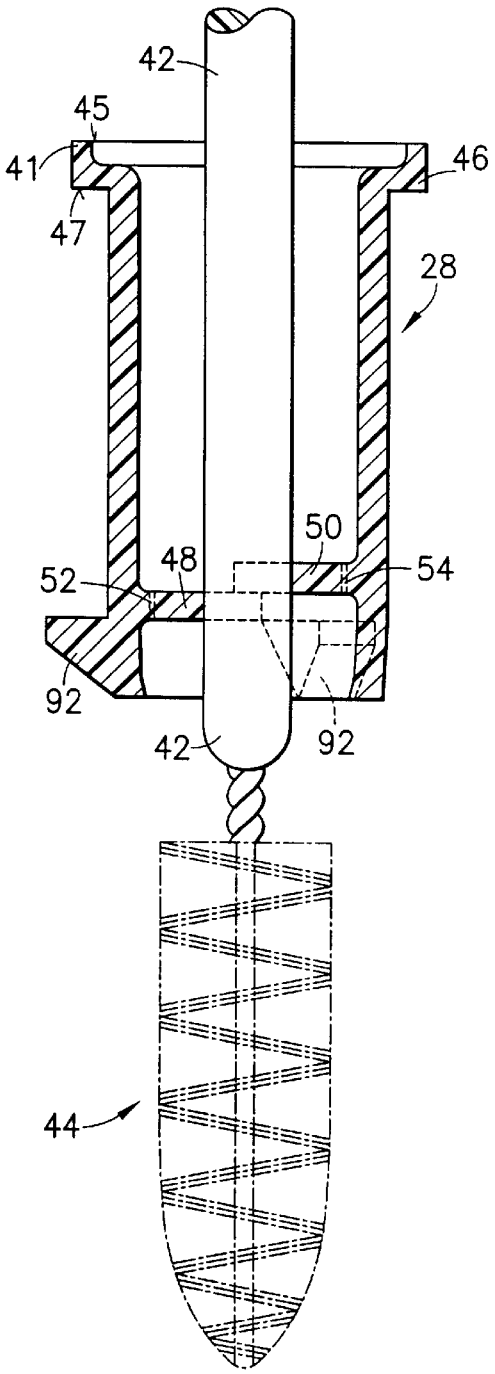
FIG. 2 is a fragmentary axial sectional view of the separator member and applicator of FIG. 1, still further enlarged and taken on the line 2—2 of FIG. 3.

Fixedly carried in the bottle neck 32 is the shroud or separator member 28 shown clearly in FIG. 2. The member 32 is cup-shaped and constituted of resilient plastic, which can be polyester elastomer for example, or other solvent-resistant composition. The member 28 encloses the intermediate portion 40 of the applicator assemblage 36, and has an annular sealing top flange 46 provided with an annular bead 41 and an under surface 47 which seals with the rim portion 26 of the bottle neck 22, and also with the annular shoulder between the portions 38 and 40 of the applicator rod assemblage 36. The top rim of the separator member 28 may be thought of as configured somewhat like a dish, or in other words, dished or inside recessed. The sealing occurs at the upper flange surface 45 and the under or lower lip or flange surface 47. Seals are thus effected between the bottle neck rim 26, the flange 46 of the separator member 28, and the portion 38 of the applicator rod. Thus the applicator rod functions as a stopper for the bottle 20.

Figure 3:
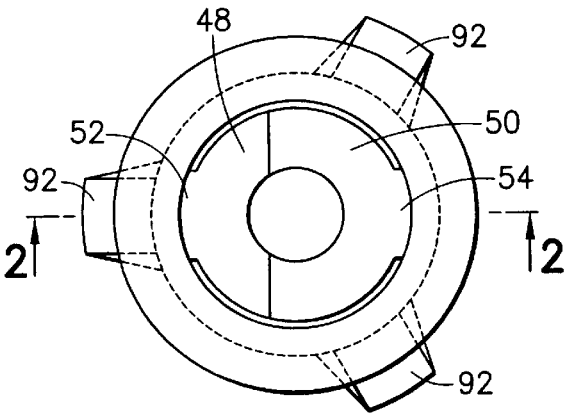
FIG. 3 is a top plan view of the separator member and applicator portions of the device shown in FIG. 2.
Figure 4:
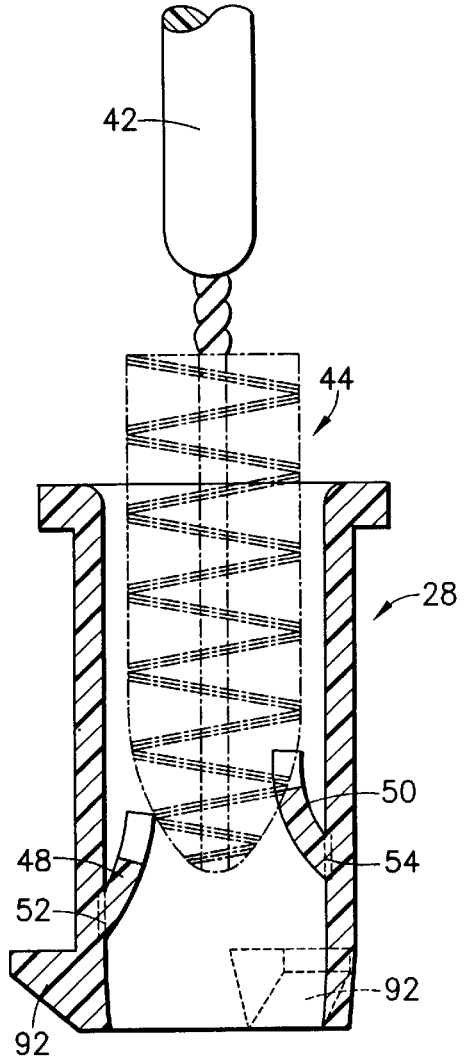
FIG. 4 is as view like that of FIG. 3 but showing the action of the doctor webs or wipers of the invention when the applicator brush is being removed.
Figure 11:
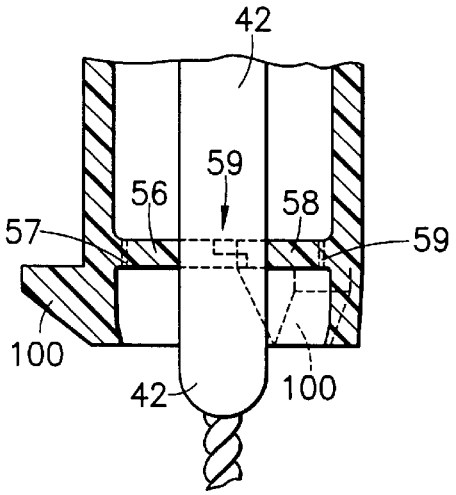
FIG. 11 is a fragmentary axial sectional view of the separator member and applicator rod, illustrating a still further embodiment of the invention.

In accordance with the present invention the separator member 28 has novel and unique doctor means adapted to control the amount of cosmetic or mascara substance that is to be withdrawn by the brush 44. In FIGS. 1–3 such means comprises a pair of overlapping C-shaped doctor webs 48 and 50 which are preferably integral with the shroud 28 and connected thereto by living hinges 52 and 54 respectively. The web 50 at its ends overlaps the ends of the web 48, and both webs can be flexed upwardly as seen in FIG. 4, when the brush 44 is being withdrawn from the bottle 20. An accurate control of the amount of mascara substance being deposited on the brush 44 and withdrawn from the bottle 20 is thus had. The webs 48 and 50 are shown in FIGS. 1–4 as being disposed at slightly different levels in the shroud 28. However, the webs can also be located at the same level or in the same plane, as shown in FIG. 11. In this figure, the webs 56 and 58 are co-planar, but their adjoining edges are undercut at the location 59, so that they can interfit with each other. The webs 56 and 58 have hinges 57 and 59 respectively. This arrangement provides a closure in conjunction with the applicator rod 42, just as is the case with the webs 48 and 50.

Alternative doctoring means are illustrated in FIGS. 5–10, which are usable either with or without the displaceable webs of FIGS. 1–4 and 11.

Figure 5:
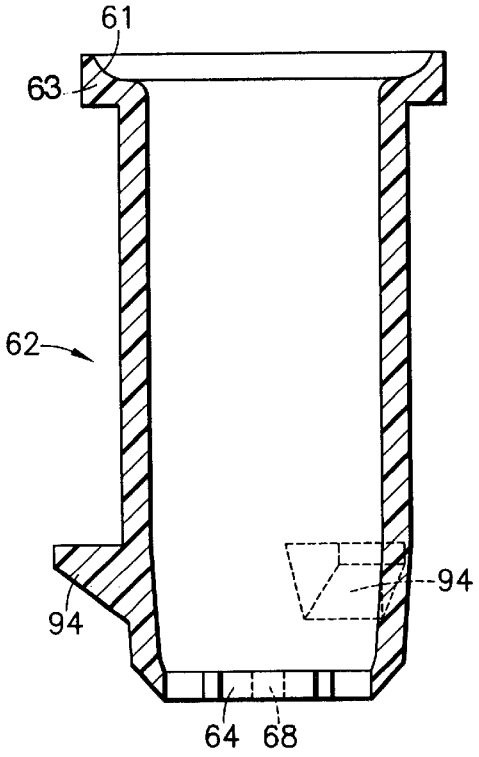
FIG. 5 is an axial sectional view of the separator member or shroud of the device, taken on the line 5—5 of FIG. 6 and showing a variation of the doctoring means thereof.
Figure 6:
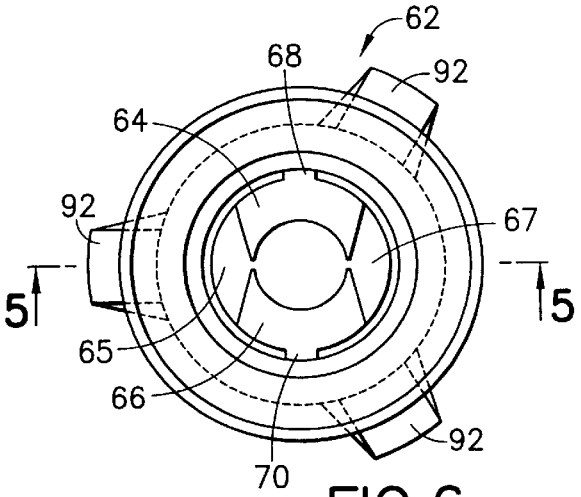
FIG. 6 is a top plan view of the separator member of FIG. 5.

In FIGS. 5 and 6, the shroud 62 has a bottom wall constituted of two sector-shaped portions 64 and 66 that function as wiper webs, being are connected to the lower extremity of the shroud by hinges 68 and 70 so that they can be swung upward under the action of removal of the applicator brush 44, just as is shown in FIG. 4. These figures illustrate an important feature of the invention whereby the brush 44 can be used as a comb, as well as an applicator.

As shown in FIG. 6, spaces 65 and 67 exist between side edges of the webs 64, 66 and the walls of the shroud 62. In FIG. 10 a space 89 exists between the end edges of the web 88 and the walls of the shroud 86. Considering the brush 44 as having stiff bristles, preferably thicker than 0.004" in diameter. When the applicator 30 is withdrawn from the container having either the shroud 62 of FIG. 6 or the shroud 86 of FIG. 9, the spaces 65, 67 or 89 will allow more of the mascara product to remain on the brush 44. But under the wiping action of the webs 64, 66 or 88 other portions of the brush 44 can be relatively free of the mascara product and can be advantageously used in the manner of a comb, to brush or comb product that has just been applied by the user. This represents an important feature of the invention. Actually the portion of the brush 44 which is wiped can carry very little of the product. Bristles in these "clean" areas can thus be used as combs, to comb the eyelashes after the mascara has been applied. Presently, consumers need to either use a separate comb for this procedure, or to wipe off product from the bristles by scraping the brush on the bottle rim. This latter makes the bottleneck contaminated, and the product flows onto the threads, rendering them sticky which adversely affects the opening and closing of the bottle. As stated above, bristles having a thickness of 0.004" or more can be used to provide a good combing action.

Figure 7:
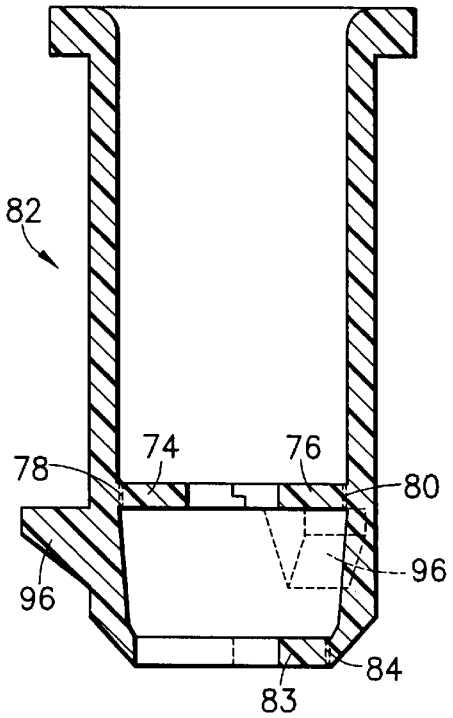
FIG. 7 is an axial sectional view, like that of FIG. 5, of the separator member of the invention but showing yet another embodiment of the invention. This view is taken on the line 7—7 of FIG. 8.
Figure 8:
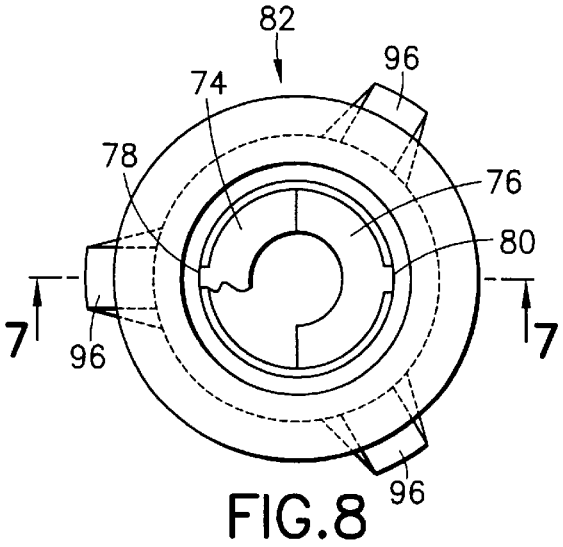
FIG. 8 is a top plan view of the separator member of FIG. 7.

In FIG. 5 the shroud 62 has a dished or inside-relieved top rim 63 which may be thought of as an annular bead portion of the flange; the groove 61 of the rim has a concave, annular surface Referring to FIGS. 7 and 8, doctor webs 74 and 76 are shown, having under-cut interfitting edges and being connected by hinges 78 and 80 to the shroud 82. The shroud 82 also has a third flexible web 83 at its lower extremity, connected to the shroud by a living hinge 84

Figure 9:
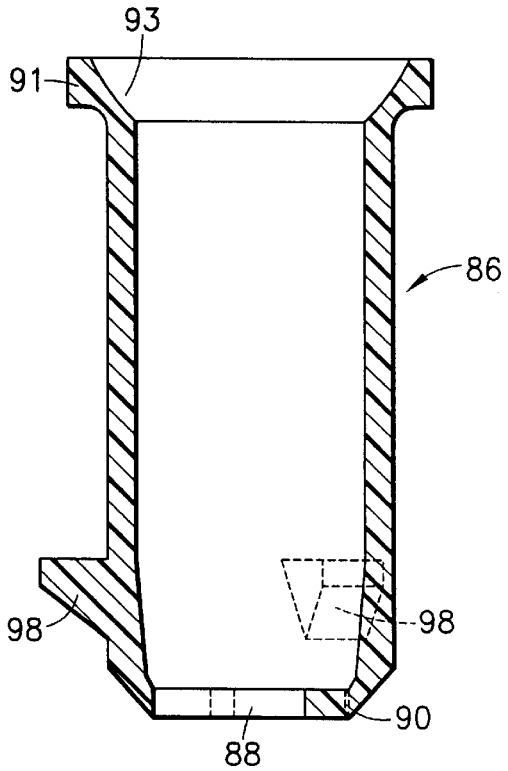
FIG. 9 is an axial sectional view like that of FIG. 7, taken on the line 9—9 of FIG. 10 and showing still another embodiment of the invention.
Figure 10:
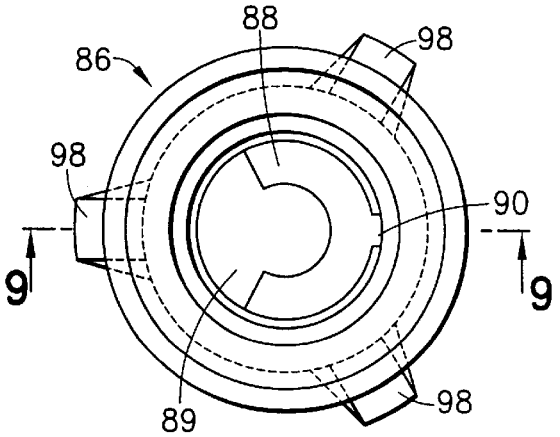
FIG. 10 is a top plan view of the separator member of FIG. 9.

FIGS. 9 and 10 show a shroud 86 having a single flexible web 88 which is connected to the shroud 86 by a hinge 90. The web 88 is C-shaped as seen in FIG. 10, extending through an arc of more than 180 degrees. The top flange of the shroud 86 is seen to have a concave surfaced shallow groove 93, and the outermost portion of the flange can be considered as an annular sealing bead.

The separator members or shrouds in the various figures have exterior sloped lugs or wings labelled respectively 92, 94, 96, 98 and 100 which cam inward when the members are forced into the bottle necks, such lugs expanding against the bottle shoulder 24 to retain the members in the bottle, as will be understood.

Figure 12:
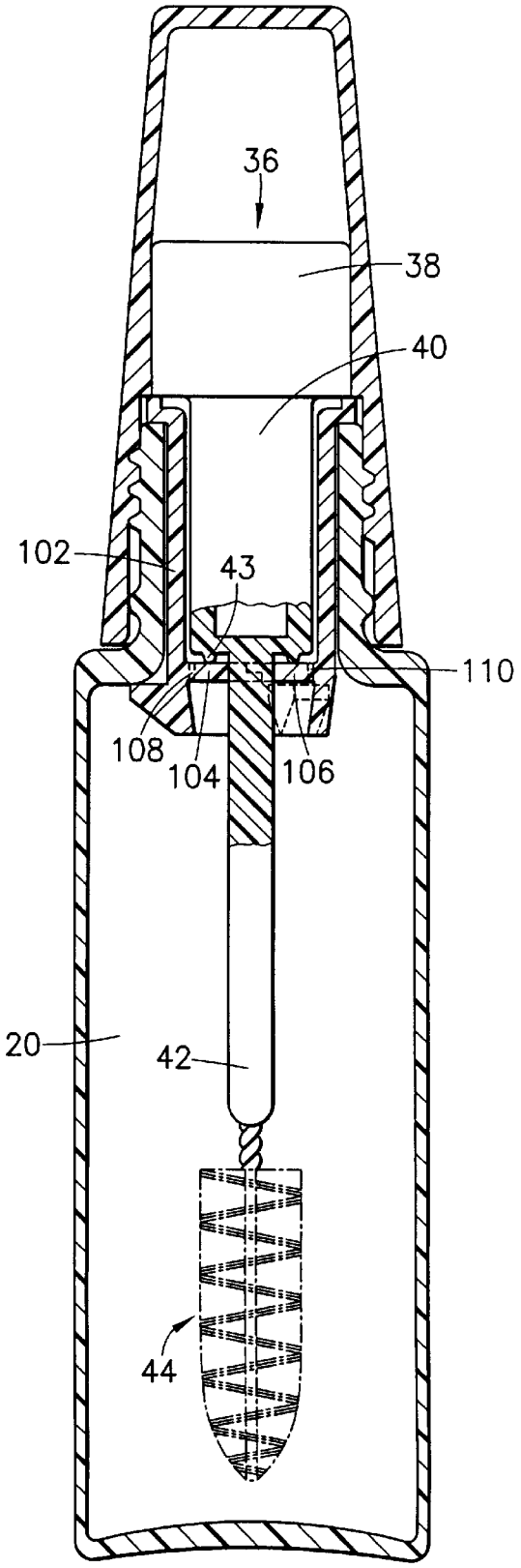
FIG. 12 is a view like that of FIG. 1, but illustrating more clearly the sealing action of the applicator and separator or shroud components.

FIG. 12 illustrates an improved assemblage according to the invention, wherein the intermediate portion 102 of the shroud member has doctoring webs 104 and 106 with hinge portions 108 and 110. The webs 104 and 106 normally closely hug the stem or rod 42 of the applicator, and when in such position they are engageable by the sealing bead 43 of the applicator. Moreover, since the webs are not fixed but instead movable by virtue of their hinges 108 and 110, they can yield a slight amount and conform to the contour of the bead 43. This makes for a softer and more effective seal of the contents of the bottle 20.

Referring to FIGS. 6 and 10 of the drawings it will be seen that the shapes of the webs 64 and 66 in FIG. 6 or the web 88 in FIG. 10 govern the size and shape of the spaces 67 and 89 which exist between the inside walls of the shroud 62 or 86 and the webs. These spaces allow for the passage of some extra mascara when the brush-applicator is being withdrawn, and thus a control is had by the masking effect of the webs, of the amount of product on the brush 44.

Also, the stiffness or rigidity of the webs as well as the shapes in the various embodiments of the invention will govern the amount of mascara that is being carried out by the applicator, and this applies as well to the thickness and stiffness of the bristles making up the brush 44. Bristles of 0.005" and more in diameter can be used, even to the point of providing a combing action. In the embodiment of FIG. 6, for example, thick bristles can be used with a thinner product to provide different results. Also, more product will be removed on the applicator where the webs 64 and 66 do not wipe the brush, as along the end portions of the webs 64 and 66.

In the embodiment of FIGS. 1–3 where the webs overlap each other, the applicator rod 42 can be wiped cleaner than in the embodiment of FIGS. 8 and 10.

It will now be seen from the foregoing that we have provided an improved and simplified dispenser and container for mascara and like cosmetic substances, which has few components that are arranged in a small and compact package. The applicator portion is provided with improved doctoring and sealing means which give an excellent control of the deposition of the mascara or other substance on the brush and better sealing of the container contents. The brush can have "clean" areas to effect a combing action, and "product carrying" areas for the application of the mascara to the eyelashes. The screw cap has a large expanse that is disposed above the transverse sealing wall, enabling an easy and comfortable grip to be had when applying the mascara. The various components are readily economically fabricated and assembled, making for a low-cost package.

The special top rim configurations of the various separator members reduce the amount product contamination in the cap and threads, and keep the bottle cleaner. The enlargement of the mouth of the separator member enables the user to replace the brush in the bottle more easily, without touching or scraping the outside of the member. These are important conveniences that a user will enjoy when using the dispenser of this invention.

Each and every one of the appended claims defines an aspect of the invention which is complete in and of itself, separate and distinct from all the others, and accordingly it is intended that each claim be treated in this manner when examined in the light of the prior art devices in any determination of novelty or validity.

Variations and modifications are possible without departing from the spirit of the invention, and portions of the improvement can be used without others.

LISTING OF THE NUMERALS

20. Container or bottle
22. Bottle neck
24. Bottle inner shoulder
26. Bottle neck rim portion
28. Separator member or shroud
30. Screw cap and applicator assemblage
32. Cap body
34. Inner screw thread
36. Applicator rod
38. Upper portion of applicator rod
40. Intermediate portion of applicator rod
41. annular top sealing bead
42. Lower portion of applicator rod
43. Circular sealing bead
44. Applicator brush
45. Top sealing surface of flange
46. Sealing flange of separator member or shroud
47. Under sealing surface of sealing flange.
48. Doctor web
50. Doctor web
52. Hinge for doctor web
54. Hinge for doctor web
56. Doctor web
57. Hinge for doctor web
58. Doctor web
59. Hinge for doctor web
61. Concave annular groove
62. Separator member or shroud
63. Annular top sealing bead
64. Doctor web
65. Space between webs 64 and 66
66. Doctor web
67. Space between webs 64 and 66
68. Hinge for doctor web
70. Hinge for doctor web
74. Doctor web
76. Doctor web
78. Hinge for doctor web
80. Hinge for doctor web
82. Separator member or shroud
83. Doctor web
84. Hinge for doctor web
86. Separator member or shroud
89. Space between ends of web 88 and wall of shroud 86
88. Doctor web
90. Hinge for Doctor web
91. Annular sealing bead
92. Lugs or wings on shroud
93. Concave annular groove
94. Lugs or wings on shroud
96. Lugs or wings on shroud
98. Lugs or wings on shroud
100. Lugs or wings on shroud.
102. Intermediate portion of applicator
104. wiper or doctor web with undercut edges
106. Wiper or doctor web with undercut edges
108. Hinge portion of web 104
110. hinge portion of web 106

What is claimed is:

1. A container and dispensing device for mascara and like cosmetic substances, comprising in combination:

a) a bottle for holding said cosmetic substances, said bottle having an externally threaded neck of reduced diameter, b) a molded plastic screw cap applicator comprising a body which is screwed on said bottle neck, said screw cap body having internal threads engaged with the threaded bottle neck, c) said applicator body having an applicator rod extending downward from the bottom of the body, d) an intermediate portion of said applicator rod forming with the screw-cap body an annular cavity which is occupied by the reduced neck of the bottle, e) a lower portion of said applicator rod projecting downward from the bottom of the screw cap body and carrying at its lower extremity an applicator brush that forms a junction at said lower extremity, f) a cup-shaped separator member disposed in and carried by the reduced neck portion of the bottle, g) said separator member enclosing said intermediate portion of the applicator rod and said member having a doctor means which controls the amount of cosmetic substances that are to be withdrawn by the brush, h) an upper portion of the applicator rod having an annular sealing surface and said separator member having a sealing means that is cooperable with said annular sealing surface of said upper portion of the applicator rod to seal the separator member to the applicator rod when said cap body is screwed onto the bottle, i) said bottle neck having an annular sealing surface disposed above said internal threads and said separator member having an upper lip portion that is engageable with the said annular sealing surface of the bottle neck to effect a seal therewith, j) said doctor means of the separator member comprising a sector-shaped web, k) hinge means connecting said sector-shaped web to the separator member, l) said doctor means comprising an additional web and hinge means therefor, both of said webs being disposed oppositely each other and having free curved edges which are spaced close to the inner walls of the separator member, m) said webs being offset vertically from each other and being located in different vertical planes.

2. A container and dispensing device as set forth in claim 1, wherein the webs have portions which overlap each other.

3. A container and dispensing device as set forth in claim 1, wherein the webs are connected to the separator member by living hinges.

4. A container and dispensing device comprising, in combination:

a) a bottle and a screw cap applicator having a brush, said applicator extending through the neck of the bottle, b) a hollow shroud member in the bottle neck, c) a C-shaped wiper web having a flat side and having a hinge for mounting the web for arcuate movement in the shroud, the shape of said web providing a free space between the web and a wall of the shroud, through which space the applicator passes to be wiped by the web, d) said web being adapted to occupy a raised wiping position against the brush of the applicator and lowered sealing position wherein the flat side thereof is sealingly engaged with the said applicator.

5. A container and dispensing device as set forth in claim 4, and further including an annular sealing bead on the applicator, for engagement with the flat side of said wiper web when the latter is in its lowered positions, thereby to effect a seal with said web.

6. A container and dispensing device for mascara and like cosmetic substances, comprising in combination:

a) a bottle for holding said cosmetic substances, said bottle having an externally threaded neck of reduced diameter, b) a molded plastic screw cap applicator comprising a body which is screwed on said bottle neck, said screw cap body having internal threads engaged with the threaded bottle neck, c) said applicator body having an applicator rod extending downward from the bottom of the body, d) an intermediate portion of said applicator rod forming with the screw-cap body an annular cavity which is occupied by the reduced neck of the bottle, e) a lower portion of said applicator rod projecting downward from the bottom of the screw cap body and carrying at its lower extremity an applicator brush that forms a junction at said lower extremity, f) a cup-shaped separator member disposed in and carried by the reduced neck portion of the bottle, g) said separator member enclosing said intermediate portion of the applicator rod and said member having a doctor means which controls the amount of cosmetic substances that are to be withdrawn by the brush, h) an upper portion of the applicator rod having an annular sealing surface and said separator member having a sealing means that is cooperable with said annular sealing surface of said upper portion of the applicator rod to seal the separator member to the applicator rod when said cap body is screwed onto the bottle, i) said bottle neck having an annular sealing surface disposed above said internal threads and said separator member having an upper lip portion that is engageable with the said annular sealing surface of the bottle neck to effect a seal therewith, j) said doctor means of the separator member comprising a sector-shaped web, k) hinge means connecting said sector-shaped web to the separator member, l) said doctor means comprising an additional web and hinge means therefor, both of said webs being disposed oppositely each other and having free curved edges which are spaced close to the inner walls of the separator member, and m) said webs having undercut edges which overlap each other.

7. A container and dispensing device for mascara and like cosmetic substances, comprising in combination:

a) a bottle for holding said cosmetic substances, said bottle having an externally threaded neck of reduced diameter, b) a molded plastic screw cap applicator comprising a body which is screwed on said bottle neck, said screw cap body having internal threads engaged with the threaded bottle neck, c) said applicator body having an applicator rod extending downward from the bottom of the body, d) an intermediate portion of said applicator rod forming with the screw-cap body an annular cavity which is occupied by the reduced neck of the bottle, e) a lower portion of said applicator rod projecting downward from the bottom of the screw cap body and carrying at its lower extremity an applicator brush that forms a junction at said lower extremity, f) a cup-shaped separator member disposed in and carried by the reduced neck portion of the bottle, g) said separator member enclosing said intermediate portion of the applicator rod and said member having a doctor means which controls the amount of cosmetic substances that are to be withdrawn by the brush, h) an upper portion of the applicator rod having an annular sealing surface and said separator member having a sealing means that is cooperable with said annular sealing surface of said upper portion of the applicator rod to seal the separator member to the applicator rod when said cap body is screwed onto the bottle, i) said bottle neck having an annular sealing surface disposed above said internal threads and said separator member having an upper lip portion that is engageable with the said annular sealing surface of the bottle neck to effect a seal therewith, j) said doctor means of the separator member comprising a sector-shaped web, k) hinge means connecting said sector-shaped web to the separator member, l) said web comprising a resilient bottom wall of the separator member, said wall having an opening through which the applicator rod extends, and m) said web comprising a circular segment extending through an arc of more than 180 degrees.

8. A container and dispensing device for mascara and like cosmetic substances, comprising in combination:

a) a bottle for holding said cosmetic substances, said bottle having an externally threaded neck of reduced diameter, b) a molded plastic screw cap applicator comprising a body which is screwed on said bottle neck, said screw cap body having internal threads engaged with the threaded bottle neck, c) said applicator body having an applicator rod extending downward from the bottom of the body, d) an intermediate portion of said applicator rod forming with the screw-cap body an annular cavity which is occupied by the reduced neck of the bottle, e) lower portion of said applicator rod projecting downward from the bottom of the screw cap body and carrying at its lower extremity an applicator brush that forms a junction at said lower extremity, f) a cup-shaped separator member disposed in and carried by the reduced neck portion of the bottle, g) said separator member enclosing said intermediate portion of the applicator rod and said member having a doctor means which controls the amount of cosmetic substances that are to be withdrawn by the brush, h) an upper portion of the applicator rod having an annular sealing surface and said separator member having a sealing means that is cooperable with said annular sealing surface of said upper portion of the applicator rod to seal the separator member to the applicator rod when said cap body is screwed onto the bottle, i) said bottle neck having an annular sealing surface disposed above said internal threads and said separator member having an upper lip portion that is engageable with the said annular sealing surface of the bottle neck to effect a seal therewith, j) said doctor means of the separator member comprising a sector-shaped web, k) hinge means connecting said sector-shaped web to the separator member, l) said doctor means comprising an additional web and hinge means therefor, both of said webs being disposed oppositely each other and having free curved edges which are spaced close to the inner walls of the separator member, and m) means on said screw cap applicator, engageable and cooperable with said webs for effecting a seal therewith when the screw cap applicator is screwed on said bottle neck.

9. A container and dispensing device comprising, in combination:

a) a bottle and a screw cap applicator having a brush, said applicator extending through the neck of the bottle, b) a hollow shroud member in the bottle neck, c) a wiper web arcuately movable in the shroud, between which web and a wall of the shroud the applicator passes to be wiped by the web, d) said web being adapted to occupy a raised wiping position against the brush of the applicator and lowered sealing position where it is sealingly engaged with the said applicator, wherein a space is provided for passage of product between a wall of the shroud member and edge portions of the web, the size and shape of said passage being a function of the configuration of the web and controlling the amount of product flowing through said passage.

* * * * *